US008584878B2

(12) United States Patent
McDowell

(10) Patent No.: US 8,584,878 B2
(45) Date of Patent: Nov. 19, 2013

(54) CLOSURE COMPRISING AN INNER SECTION AND AN OUTER SECTION FOR SEALING AN OPENING

(75) Inventor: Craig McDowell, County Antrim (GB)

(73) Assignee: Crew Mouldings Limited, Larne, County Antrim (GB)

( * ) Notice: Subject to any disclaimer, the term of this patent is extended or adjusted under 35 U.S.C. 154(b) by 39 days.

(21) Appl. No.: 13/146,343

(22) PCT Filed: Jan. 26, 2010

(86) PCT No.: PCT/EP2010/000436

§ 371 (c)(1),
(2), (4) Date: Jul. 26, 2011

(87) PCT Pub. No.: WO2010/084022

PCT Pub. Date: Jul. 29, 2010

(65) Prior Publication Data

US 2011/0284492 A1 Nov. 24, 2011

(30) Foreign Application Priority Data

Jan. 26, 2009 (GB) ..... 0901185.9

(51) Int. Cl.
*B65D 41/00* (2006.01)

(52) U.S. Cl.
USPC ..... 215/328; 215/327; 215/324; 215/280

(58) Field of Classification Search
USPC ..... 215/324, 327, 328, 275, 280, 334; 413/2, 26
See application file for complete search history.

(56) References Cited

U.S. PATENT DOCUMENTS

| | | | | | |
|---|---|---|---|---|---|
| 703,527 | A | * | 7/1902 | Brewington | 215/324 |
| 1,472,889 | A | * | 11/1923 | Ruggiero | 215/275 |
| 2,161,993 | A | * | 6/1939 | Berch et al. | 215/324 |
| 2,812,093 | A | * | 11/1957 | Podesta | 215/275 |
| 3,231,123 | A | | 1/1966 | Heierle | |
| 4,279,353 | A | * | 7/1981 | Honma | 215/254 |
| 5,379,908 | A | | 1/1995 | Rohe | |
| 5,957,314 | A | * | 9/1999 | Nishida et al. | 215/249 |

FOREIGN PATENT DOCUMENTS

| | | | |
|---|---|---|---|
| DE | 8805665 | U1 | 7/1988 |
| DE | 4135470 | A1 | 4/1993 |
| GB | 446612 | A | 5/1936 |

OTHER PUBLICATIONS

International Search Report.
Written Opinion (Form PCT/ISA/237) for International Application No. PCT/EP2010/000436.

* cited by examiner

*Primary Examiner* — J. Gregory Pickett
*Assistant Examiner* — Raven Collins
(74) *Attorney, Agent, or Firm* — Harness, Dickey & Pierce, P.L.C.

(57) ABSTRACT

This invention relates to a closure for sealing an opening of a container. In particular, the present invention relates to a closure (10) for sealing a mouth of a container, such as a bottle. According to a first aspect of the present invention there is provided a closure for sealing an opening defined by a mouth of a container, the closure comprising a body (12) adapted to overlie the mouth; and a discontinuous skirt (14) extending from the body, wherein the skirt is deformable between an open position and a closed position. The present invention also provides methods for applying the closure to a container.

20 Claims, 8 Drawing Sheets

CLOSURE COMPRISING AN INNER SECTION AND AN OUTER SECTION FOR SEALING AN OPENING

CROSS-REFERENCE TO RELATED APPLICATIONS

This application is a U.S. national stage filing under 35 U.S.C. §371 of International Application No. PCT/EP2010/000436, filed Jan. 26, 2010 (published as WO 2010/084022 on Jul. 29 2010), which claims the benefit of and priority to United Kingdom Application No. GB 0901185.9, filed on Jan. 26, 2009. The entire disclosures of each of the above applications are incorporated herein by reference.

This invention relates to a closure for sealing an opening of a container. In particular, the present invention relates to a closure for sealing a mouth of a container, such as a bottle. The present invention also provides methods for applying the closure to a container.

BACKGROUND

The crown closure has been in existence since 1892 and is still the closure of choice for use on glass bottles, owing to its simplicity and effectiveness.

The crown closure, however, is not ideally suited to modern lightweight plastic or aluminium bottles because the bottle must be manufactured to the similar dimensions, in terms of thickness or strength, as a glass bottle to allow it to withstand the pressures and forces associated with the application of the closure, which is forced down and crimped around the top lip of the bottle. The standard screw closure has two main short comings in that the bottle must provide a tall and relatively heavy, in terms of material usage, thread form for retention of the closure, which reduces the opportunities to remove material, and hence weight, from the bottle. Particularly in the case of beer, the air volume entrapped in a screw closure, with its longer skirt length relative to a crown closure, has a detrimental effect on the keeping quality of the beer, because it is preferable to keep the levels of oxygen in contact with the product to a minimum.

Containers for fluids, in particular liquids, are commonly manufactured from aluminium, or a thermoplastic polymer resin such as polyethylene terephthalate [poly(ethylene terephthalate) or PET]. PET is often chosen in the manufacture of liquid containers, for its lightweight characteristic, high degree of impact resistance, and tensile strength. PET containers, especially bottles for liquids, are formed using two basic moulding methods, one-step or two-step.

In the two-step method, a first machine injection moulds a preform having a neck and a body. The neck of the preform has threads for applying a threaded screw cap, which threads are moulded into place in situ. The body of the preform is significantly thicker, because it is inflated into its final shape in the second step. In this step, the body of the preform is rapidly heated to high temperature, typically 95-115° C., and then stretched in the axial direction and inflated against a two-part mould to form the final shape of the bottle.

In the one-step method, the entire process from raw material to finished container is conducted within one machine, making it especially suitable for moulding non-standard shapes (custom moulding).

Bottles formed by either moulding method find utility in the food industry as containers for liquids such as carbonated drinks. The threads provided at the neck of the preform can, however, comprise a substantial weight, typically approximately 8-10% of the overall weight of the bottle.

Accordingly, it is an object of the present invention to provide a closure, which circumvents at least some of the shortcomings associated with the state of the art.

SUMMARY OF THE INVENTION

According to a first aspect of the present invention there is provided a closure for sealing an opening defined by a mouth of a container, the closure comprising a body adapted to overlie the mouth; and a discontinuous skirt extending from the body, wherein the skirt is deformable between an open position and a closed position.

By the term "discontinuous" is meant having at least one point of discontinuity, and is intended to include at least one break, gap, opening, similar circumferential interruption, or a combination thereof, to the skirt.

Preferably, the body has a first face and a second face. Preferably, in use, the first face is a container-engagable face. Further preferably, in use, the second face is an exterior face.

Preferably, the body is substantially discoid.

Preferably, in the open position, a free end of the skirt defines a circumference greater than the outer circumference of the mouth of the container.

Preferably, in the closed position, a free end of the skirt defines a circumference substantially equal to the outer circumference of the mouth of the container.

Preferably, the skirt comprises a plurality of arms, extending from the body.

Optionally, the skirt comprises a plurality of spaced apart arms, extending from the body.

Preferably, each arm has a first face and a second face. Preferably, in use, the first face is a container-engagable face. Further preferably, in use, the second face is an exterior face.

Preferably, a point of discontinuity is defined between adjacent arms.

Optionally, in the open position, the plurality of arms extends substantially radially from the body.

Optionally, in the closed position, some or all of the plurality of arms are oriented such that the container-engagable face of some or all of the arms is located, in use, adjacent the mouth of the container. Further optionally, in the closed position, some or all of the plurality of arms are oriented such that the container-engagable face of some or all of the arms is located, in use, in side-by-side relationship with the mouth of the container.

Optionally, each arm is hingedly mounted to the body.

Optionally, each arm is mounted to the body by a live hinge. By "live hinge" is meant a joint, located at the interface of two bodies, and permitting relative pivotable movement of the bodies about the geometrical axis of the joint, wherein the joint is integral to one, or both, of the bodies.

Optionally, the live hinge comprises a line of weakness.

Preferably, at least one arm further comprises a retaining element.

Preferably, the retaining element is located at the container-engagable face of the at least one arm.

Preferably, the retaining element extends substantially inward with respect to the longitudinal axis of the arm.

Preferably, the retaining element extends substantially perpendicular from the exterior face of the arm. Preferably, in use, the retaining element is oriented toward the mouth of the container.

Optionally, at least some of the arms are adapted to be secured to each adjacent arm. Preferably, each arm is adapted to be secured to each adjacent arm.

Optionally or alternatively, the closure further comprises means for securing each arm to an adjacent arm. Optionally, the securing means comprises a connection member adapted to form a connection between at least some of the arms, in the closed position. Further optionally, the securing means comprises an annular member, adapted to at least partially circumscribe some or all of the arms, in the closed position.

Preferably, in the closed position, the at least part of each arm can form at least a partial connection with the at least part of an adjacent arm.

Optionally, in the closed position, a connection is formed between an arm and at least one adjacent arm. Further optionally, the connection is formed between some or each of the arms. Preferably, the connection is made between each arm.

Optionally, in the closed position, the connections between adjacent arms together form a ring. Preferably, the ring is a continuous ring. Optionally, in the in-use, closed position, the ring at least partially circumscribes the mouth of the container.

Optionally, the closure further comprises a plurality of fingers.

Preferably, each finger has a first face and a second face. Preferably, in use, the first face is a container-engagable face. Further preferably, in use, the second face is an exterior face.

Optionally, the plurality of fingers extends from the body. Preferably, the plurality of fingers extends from the container-engagable face of the body. Further optionally, the plurality of fingers extends substantially perpendicular from the container-engagable face of the body.

Optionally, the plurality of fingers is interspersed with the plurality of arms.

Optionally, some or all of the plurality of fingers are oriented such that the container-engagable face of some or all of the fingers is located, in use, adjacent an outer surface of the mouth of the container. Further optionally, some or all of the plurality of fingers are oriented such that the container-engagable face of some or all of the fingers is located, in use, in side-by-side relationship with an outer surface of the mouth of the container.

Alternatively, some or all of the plurality of fingers are oriented such that the exterior face of some or all of the fingers is located, in use, adjacent an inner surface of the mouth of the container. Optionally, some or all of the plurality of fingers are oriented such that the exterior face of some or all of the fingers is located, in use, in side-by-side relationship with an inner surface of the mouth of the container.

Optionally, at least one finger further comprises a retaining element.

Preferably, the retaining element is located at the container-engagable face of the at least one finger.

Preferably, the retaining element extends substantially inward with respect to the longitudinal axis of the finger.

Preferably, in use, the retaining element is oriented toward the mouth of the container.

Optionally, the at least part of the exterior face of each finger is adapted to receive at least part of the container-engagable face of an adjacent arm, in the closed position.

Optionally, the exterior face of each finger comprises at least one recess, shaped and dimensioned to receive at least part of the container-engagable face of an adjacent arm. Preferably, the exterior face of each finger comprises two recesses, each shaped and dimensioned to receive at least part of a container-engagable face of a respective adjacent arm.

Optionally, the closure comprises an inner section and an outer section.

Optionally, the outer section comprises a first body and a discontinuous skirt, optionally comprising a plurality of arms.

Optionally, the inner section comprises a second body and a plurality of fingers.

Preferably, each finger of the second body has a first face and a second face. Preferably, in use, the first face is a container-engagable face. Further preferably, in use, the second face is an exterior face.

Optionally, the plurality of fingers extends from the second body. Preferably, the plurality of fingers extends from the container-engagable face of the second body. Further optionally, the plurality of fingers extends substantially perpendicular from the container-engagable face of the second body.

Optionally, some or all of the plurality of fingers are oriented such that the container-engagable face of some or all of the fingers is located, in use, adjacent an outer surface of the mouth of the container. Further optionally, some or all of the plurality of fingers are oriented such that the container-engagable face of some or all of the fingers is located, in use, in side-by-side relationship with an outer surface of the mouth of the container.

Alternatively, some or all of the plurality of fingers are oriented such that the exterior face of some or all of the fingers is located, in use, adjacent an inner surface of the mouth of the container. Optionally, some or all of the plurality fingers are oriented such that the exterior face of some or all of the fingers is located, in use, in side-by-side relationship with an inner surface of the mouth of the container.

Optionally, at least one finger of the inner section, or at least one arm of the outer section, further comprises a retaining element.

Preferably, the retaining element is located at the container-engagable face of the at least one finger of the inner section, or the at least one arm of the outer section.

Preferably, the retaining element extends substantially inward with respect to the longitudinal axis of the at least one finger of the inner section, or the at least one arm of the outer section.

Preferably, in use, the retaining element is oriented toward the mouth of the container.

Preferably, the outer section is adapted to receive the inner section.

Optionally, the outer section is secured to the inner section. The outer section may be mechanically secured to the inner section, such as an interference fit arrangement. Further optionally, the outer section may be adhered to the inner section. Adhesion of the outer section to the inner section may be achieved using welding techniques, adhesives, or any other suitable technique envisaged by the skilled person.

Optionally, the closure is formed from a deformable material. Further optionally, the closure is formed from a thermally deformable material. Still further optionally, the closure is formed from a thermally deformable material, such as plastic or metal.

Optionally, the closure is formed from a thermally deformable material, such as plastic. Preferably, the material is a thermoplastic material. Optionally, the thermoplastic material is a crystalline thermoplastic material. The thermoplastic material may be selected from the group comprising, but not limited to, acetal, polyethylene terephthalate (PET), nylon, topas, acrylonitrile butadiene styrene (ABS), polycarbonate, and polyolefins (POE).

Alternatively, the closure is formed from a thermally deformable material, such as metal. Optionally, the metal is a metal alloy. The metal or metal alloy may be selected from the group comprising, but not limited to, aluminium and copper.

Optionally, at least part of each arm is thermally deformable. Further preferably, an at least terminal end of each arm is thermally deformable. The at least terminal end of each arm may be formed from a thermally deformable material.

Optionally or additionally, at least part of each finger is thermally deformable. Further preferably, an at least terminal end of each finger is thermally deformable. The at least terminal end of each finger may be formed from a thermally deformable material.

By "thermally deformable" is meant capable of transforming state in response to a change in internal energy. Preferably, an increase in internal energy results in a transition from a solid state to a liquid state, referred to herein as "melting". Optionally, a decrease in internal energy results in a transition from a liquid state to a solid state, referred to herein as "solidifying". It is understood that the change in state does not necessarily have to be from solid to liquid but also encompasses semi-solid phases.

Optionally, the closure is formed from a bondable material.

Optionally, at least part of each arm is bondable. Further preferably, an at least terminal end of each arm is bondable. The at least terminal end of each arm may be formed from a bondable material.

Optionally or additionally, at least part of each finger is bondable. Further preferably, an at least terminal end of each finger is bondable. The at least terminal end of each finger may be formed from a bondable material.

By "bondable" material is meant a material capable of forming a bond (coalescing). Optionally, the bond extends between two bodies to be bonded. The bodies may be formed from the same, or from different, materials. The bodies may be formed from the same, or from different, bondable materials. Preferably, the bodies are formed from the same bondable material.

Optionally, the bond extends between two bodies, such that a union (fusion) of at least part of one or each of the bodies is formed (coalescence). Once bonded, the two bodies optionally together form an integrated body. It is understood that the bond may extend at least part of the interface between two bodies or the bond may extend the entirety of the interface between two bodies.

Optionally, the bond is formed at the microscopic level. Further optionally, the bond is formed at the atomic level. It is understood that the bondable material may not transform state in response to a change in internal energy, but that the bond may result from atomic diffusion, whereby atoms from the bondable material diffuse to form an atomic bond between two bodies.

Optionally, at least part of each arm or finger can form at least a partial connection, such as a bond, with at least part of an adjacent arm or finger.

Optionally, the closure is formed from a bondable material, such as metal. Optionally, the metal is a metal alloy. The metal or metal alloy may be selected from the group comprising, but not limited to, aluminium and copper.

Optionally, when the closure comprises an inner section and an outer section, the inner section and the outer section may be formed from the same or from different materials. Preferably, the inner section and the outer section are each formed from the same material.

Optionally, the inner section and the outer section are each formed from a deformable material, optionally a thermally deformable material, such as plastic or metal. Alternatively, the inner section and the outer section are each formed from a bondable material, such as metal.

Optionally or additionally, at least some or all of the arms or fingers of the skirt are adapted to facilitate increasing the internal energy. Preferably, at least some or all of the arms or fingers of the skirt are shaped and dimensioned to facilitate increasing the internal energy. Further preferably, at least part of at least some or all of the arms or fingers of the skirt are shaped and dimensioned to facilitate increasing the internal energy.

Preferably, the terminal edge of at least some or all of the arms or fingers of the skirt are shaped and dimensioned to facilitate increasing the internal energy. Preferably, the terminal edge extends laterally to form a point or edge.

Optionally or additionally, the closure further comprises means for reducing the passage of fluid, once applied to a container.

Preferably, the reducing means comprises a fluid impermeable membrane. Preferably, the membrane is formed from a metal. Preferably, the metal is aluminium. Alternatively the metal is steel or tin-free steel (TFS).

Optionally, the closure is adapted to at least partially receive a device such as a widget to manage the characteristics of the foam produced by bubbles of gas released from a carbonated liquid. Further optionally, the inner section of the closure is adapted to at least partially receive a device such as a widget to manage the characteristics of the foam produced by bubbles of gas released from a carbonated liquid.

Optionally, or alternatively, the body of the closure further comprises a neck.

Preferably, the neck extends from the body. Further preferably, the neck extends from the exterior face of the body. Still further preferably, the neck extends substantially perpendicular from the exterior face of the body.

Preferably, the neck is adapted to allow passage of a fluid therethrough. Further preferably, the neck is substantially cylindrical in form having open ends. Additionally, the body is adapted to allow passage of a fluid therethrough. Preferably, the body comprises an aperture to allow passage of a fluid therethrough.

Optionally, or additionally, the neck further comprises a screw thread. Preferably, the screw thread is located on the outer curved surface of the neck.

Alternatively, the closure further comprises a stopper or plug.

Preferably, the stopper or plug extends from the body. Further preferably, the stopper or plug extends from the container-engagable face of the body. Still further preferably, the stopper or plug extends substantially perpendicular from the container-engagable face of the body.

Optionally, the stopper or plug is arranged to reversibly form a seal with the opening of the container. Optionally, the stopper or plug is shaped and dimensioned to form an interference fit with the opening of the container.

Optionally or alternatively, the closure further comprises means for dispensing liquid or allowing the passage of liquid therethrough.

Optionally, the dispensing means is adapted to be operable between a closed position and an open position.

Optionally, the dispensing means comprises a spout.

Optionally, the dispensing means comprises a spout adapted to be operable between a closed position and an open position. Further optionally, the dispensing means comprises a spout, which is hingedly mountable to the closure.

Optionally, the spout is substantially cylindrical and adapted to be hingedly mountable to the closure. Further optionally, the spout is substantially cylindrical having open ends and adapted to be hingedly mountable to the closure.

Optionally, the dispensing means comprises a spout, which is hingedly mountable to the closure by a ball-and-socket assembly.

Optionally, the spout is integral to the ball.

Optionally, the socket is integral to the closure.

Optionally, the socket further comprises means for receiving at least part of the spout to impede the passage of liquid through the spout. Optionally, the receiving means comprises at least one channel, which is shaped and dimensioned to reversibly receive at least part of the spout. Optionally, the or each channel is shaped and dimensioned to, in the closed position, to form an interference fit with at least one of the open ends of the spout.

Optionally, the spout is hingedly operable between a closed position and an open position. It is understood that, in the closed position, the spout is arranged to impede the passage of liquid therethrough, and in the open position, the spout is arranged to allow the passage of liquid therethrough.

According to a second aspect of the present invention there is provided a method of sealing an opening defined by a mouth of a container using a closure according to the first aspect of the present invention; the method comprising the steps of: applying the closure to the mouth of the container, and deforming the discontinuous skirt from the open position to the closed position.

Optionally, the deforming step comprises increasing the internal energy of at least part of the closure. Further optionally, applying energy to the closure increases the internal energy. Still further optionally, the internal energy is increased by applying energy to the skirt. The energy may be applied from an external energy source.

Optionally, the amount of externally applied energy is sufficient to thermally deform at least part of the closure. Further optionally, the amount of external applied energy is sufficient to increase the temperature of the at least part of the closure to the melting temperature of the material from which the at least part of the closure is formed. Still further optionally, the amount of external applied energy is sufficient to melt the at least part of the closure. The type and amount of externally applied energy is dependent on the physical properties of the material from which the closure is formed, and may each be independently selected by one skilled in the art.

Optionally, the amount of externally applied energy is sufficient to form a bond between at least two parts of the closure. Further optionally, the amount of external applied energy is sufficient such that the bond may result from atomic diffusion, whereby atoms from the at least two parts of the closure diffuse to form an atomic bond between the at least two parts of the closure. The type and amount of externally applied energy is dependent on the physical properties of the material from which the closure is formed, and may each be independently selected by one skilled in the art.

Optionally, the method further comprises the step of increasing the internal energy of at least part of the skirt. Further optionally, the method further comprises the step of increasing the internal energy of at least part of the arms of the skirt.

Preferably, the at least part of the arms of the skirt are melted. Further preferably, the at least part of the arms is melted to form at least a partial connection with an adjacent arm.

Alternatively, a bond is formed between the at least part of the arms of the skirt. Preferably, at least a partial bond is formed between the at least part of an arm and an adjacent arm.

Optionally or additionally, at least part of the fingers of the closure are melted. Further optionally or additionally, the at least part of the arms is melted to form at least a partial connection with an adjacent finger, or an adjacent arm of the skirt.

Optionally or additionally, a bond is formed between at least part of the fingers of the closure. Further optionally or additionally, at least a partial bond is formed between the at least part of an arm and an adjacent finger, or an adjacent arm of the skirt.

Optionally or additionally, the method further comprises the step of decreasing the internal energy of at least part of the closure. Preferably, the at least partial connection formed between adjacent arms or fingers is solidified to form a continuous ring.

When the closure is formed from a thermoplastic material such as acetal, polyethylene terephthalate (PET), nylon, topas, acrylonitrile butadiene styrene (ABS), polycarbonate or polyolefins (POE); the externally applied energy may be in the form of thermal energy. Optionally, the amount of thermal energy applied to the closure is sufficient to cause the closure to have a temperature in the range of about 160° C. to about 250° C.

Optionally, the external energy applied is in the form of a laser.

Preferably, the externally applied energy is in the form of ultrasonic, or vibrational, energy. Optionally, the energy is a form of thermal energy. The ultrasonic, or vibrational, energy can be applied using a tool such as a sonotrode, which can be reversibly positioned over the closure. It is envisaged that a bore of the sonotrode is sized and dimensioned to ensure contact between the sonotrode and the part, or parts, of the closure to be thermally deformed.

Optionally or additionally, the bore of the sonotrode is arranged to apply pressure radially inwards on the closure to ensure the desired shape is obtained and retained, once the sonotrode has been removed.

Alternatively, the bore of the sonotrode is arranged to apply pressure at a point on or at the closure.

Optionally, the ultrasonic, or vibratuional, energy may be applied in an axial vibration or via a torsional vibration. The amplitude of the vibration is envisaged to be about 125 μm peak to peak, at a frequency of 20 kHz. It is understood that the sonotrode will be connected to a suitable amplifier and generator, in operation.

Optionally, the energy may be in the form of induction, or electromagnetic, energy. Optionally, the induction, or electromagnetic, energy is applied using an electrical discharge transformer such as an induction coil. It is understood that the induction coil will be connected to a suitable generator, in operation.

The induction coil may surround each closure individually, or alternatively, the energy may be applied in a linear nature to simultaneously span several closures applied to a plurality of containers to which the closures are applied. Optionally, the induction coil is arranged to apply energy at a point on or at the closure.

According to a third aspect of the present invention there is provided a method of removing a closure according to the first aspect of the present invention applied to an opening defined by a mouth of a container, the method comprising the steps of introducing a point of discontinuity to the skirt.

According to a fourth aspect of the present invention, there is provided an assembly system for sealing an opening defined by a mouth of a container using a closure according to the first aspect of the present invention; the assembly system comprising means for applying a closure to the mouth of the container, and means for deforming the discontinuous skirt from the open position to the closed position.

BRIEF DESCRIPTION OF THE DRAWINGS

Six embodiments of the present invention will now be described, with reference to the accompanying drawings, wherein similar numbering has been used to denote like features, and in which.

DETAILED DESCRIPTION OF THE DRAWINGS

Figure 1A:
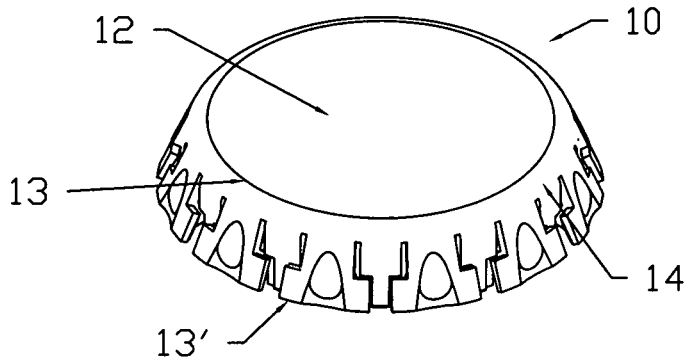
FIG. 1*a* is a perspective view of a closure according to a first embodiment of the present invention.
Figure 1B:
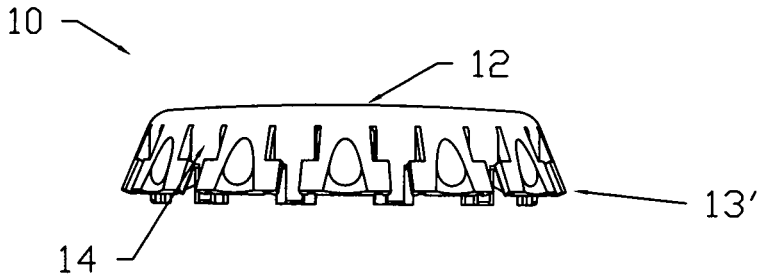
FIG. 1*b* is a side elevation of the closure of FIG. 1*a;*

Referring now to FIGS. 1*a* and 1*b*, there is shown a closure 10 according to a first embodiment of the present invention. The closure comprises a body 12 and a skirt 14. The body 12 is generally discoid and planar in shape. The skirt 14 is generally annular having a fixed edge 13, which is fixed to the circumferential edge of the body 12; and a free circumferential edge 13'.

Figure 2A:
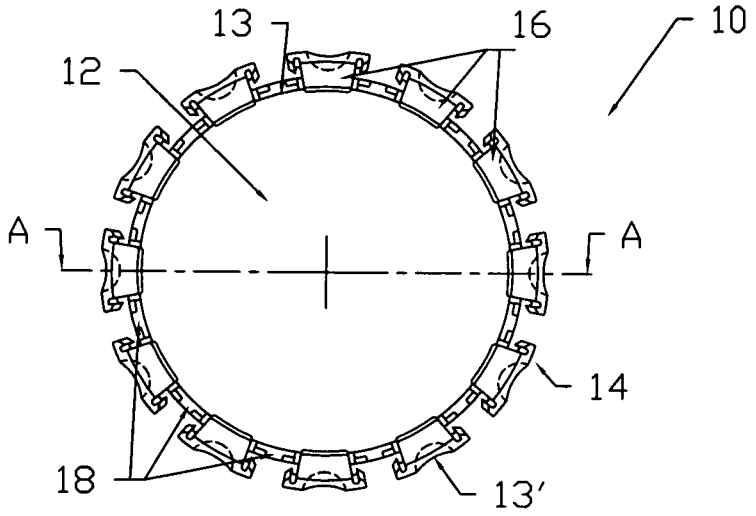
FIG. 2*a* is an underside plan view of the closure of FIG. 1*a;*

FIG. 2*a* is a plan view of an underside of a closure 10 according to a first embodiment of the present invention. The skirt 14 comprises a plurality of spaced apart arms 16, and a plurality of fingers 18. The plurality of arms 16 is tandemly interspersed with the plurality of fingers 18.

Each of the arms 16 is hingedly attached to the body 12, at a fixed edge 13 of the skirt, thereby facilitating operable displacement of each of the arms 16 between an open position and a closed position. In the open position, the circumferential edge 13' of each arm 16 defines a circumference greater than the outer circumference of a mouth of a container to be sealed (not shown).

Each of the fingers 18 is substantially fixed to the body 12, at a fixed edge 13, and extends substantially perpendicular from the plane of the container-engagable face body 12. In the open position, the fixed edge 13 of each finger 18 defines a circumference generally equal to the outer circumference of a mouth of a container to be sealed (not shown), such that when the closure 10 is applied to the mouth of a container (not shown), the container-engagable face of each finger 18 is substantially adjacent the mouth of the container.

In the closed position, the circumferential edge 13' of each arm 16 is located substantially adjacent to a respective finger 18.

Figure 2B:
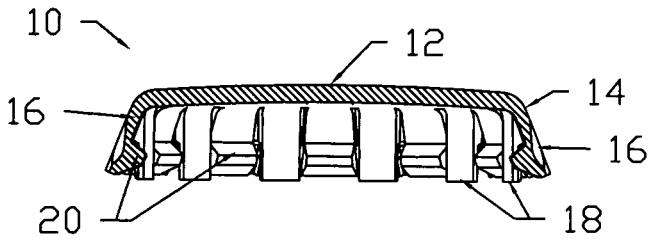
FIG. 2*b* is a sectional side elevation through the line A-A of FIG. 2*a;*

Referring to FIG. 2*b*, a generally tetrahedral retaining element 20 is provided adjacent the circumferential edge 13' of each arm 16. Each retaining element 20 projects substantially perpendicular from the plane of the exterior face of the arm 16, and is generally inwardly oriented with respect to the body 12.

Figure 4A:
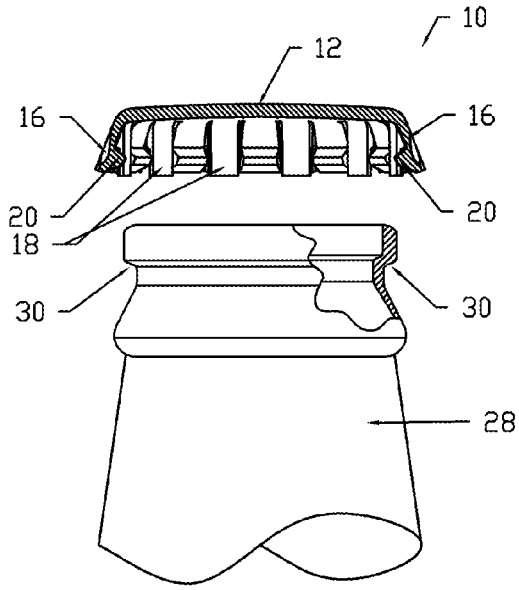
FIG. 4 illustrates the steps of providing a closure according to the present invention (4*a*), applying the closure to the mouth of the container (4*b*), and deforming the skirt from the open position the closed position (4*c*)
Figure 4B:
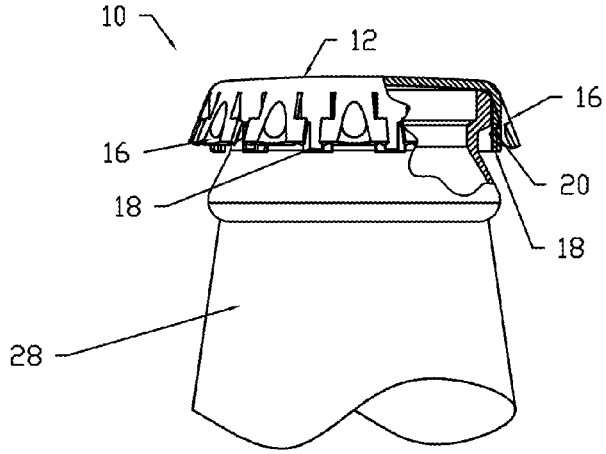

FIG. 4*a* illustrates the application of a closure 10 to a container such as a bottle 28. Prior to application, the arms 16 are in the open position. The closure 10 is applied to the bottle 28 such that the container-engagable face of the body 12 overlies the opening defined by the mouth 30 of the bottle 28. Each of the fingers 18 locates adjacent to, and circumscribes, the mouth 30 of the bottle 28, temporarily retaining the closure 10 at the mouth 30 of the bottle 28, FIG. 4*b*.

Figure 4C:
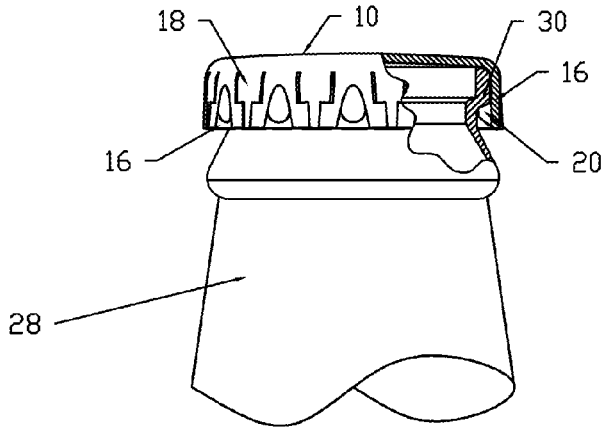

Referring to FIG. 4*c*, once the closure 10 is applied, each of the arms 16 is deformed to the closed position, whereby each arm 16 locates adjacent a finger 18. The retaining elements 20 can locate adjacent a mouth 30 of the bottle 28, such that the mouth 30 acts as a stop to inhibit removal of the closure 10 from the bottle 28.

To seal the opening defined by the mouth 30 of the bottle 28, the arms 16 are deformed such that it forms a continuous connection with an adjacent finger 18. It is envisaged that the circumferential edge 13' of each arm 16 is deformed such that it forms a continuous connection, optionally or additionally, with an adjacent arm 16 or an adjacent finger 18. A continuous ring is formed between the arms 16 and/or the fingers 18, which secures the closure 10 to the mouth 30 of the bottle 28, thereby sealing the opening defined by the mouth 30.

Each arm 16 can be deformed by applying energy to the closure 10. The energy may be in the form of thermal energy, sufficient to cause deformation to the closure 10. Preferably, the energy is applied locally to the skirt 14 of the closure 10, such that energy sufficient to form a continuous connection between adjacent arms 16, and fingers, 18 of the skirt 14. The energy may be in the form of heat applied, for example, by an induction coil. Alternatively, the energy may be in the form of ultrasonic vibration applied, for example, by a sonotrode. The type of energy applied, and the method of application, is dependent on the material from which the closure 10 is formed, and may be selected by one skilled in the art. It is envisaged that the closure 10 will be formed from a crystalline thermoplastic material, such as acetal, PET, nylon, topas, ABS, or polycarbonate.

Once sealed, the continuous ring formed between the arms 16 and/or the fingers 18 of the skirt 14 provides means for securely retaining the closure 10 to the mouth of the container. Advantageously, the deformation of each arm 16 results in a continuous connection with an adjacent arm 16 and/or an adjacent finger 18, provides a tight seal for securing the closure 10 to the mouth 30 of the container 28, regardless of differences in shape or size of the mouth, or manufacturing deficiencies such as chips or irregular structure.

To remove the closure 10 from an opening defined by a mouth 30 of a container 28 previously sealed by the above method, a break defining a point of discontinuity is introduced in the continuous ring formed between the arms 16 and/or the fingers 18. Advantageously, the closure, in the closed position, is shaped and dimensioned to be partially received in a conventional bottle opener, such that the break can be introduced to the continuous ring using conventional bottle opening means. The continuous ring thereby also acts as a tamper evident seal, which is advantageously not presently provided on such closures. Moreover, the continuous ring, once a break has been introduced, is removed from the bottle along with the closure 10. With conventional tamper evident seals, a potion of the seal is retained on the container, and means for retaining the portion of the seal must be provided by the container. The present invention circumvents the requirements for such means.

Figure 3A:
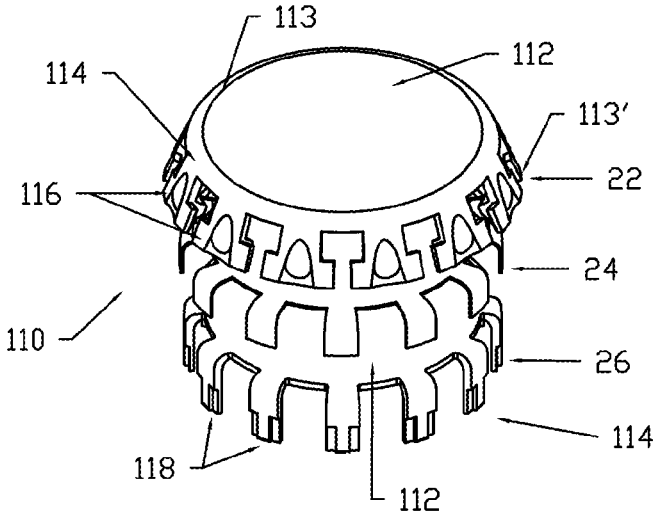
FIG. 3*a* is an exploded perspective view of a closure according to a second embodiment of the present invention.
Figure 3B:
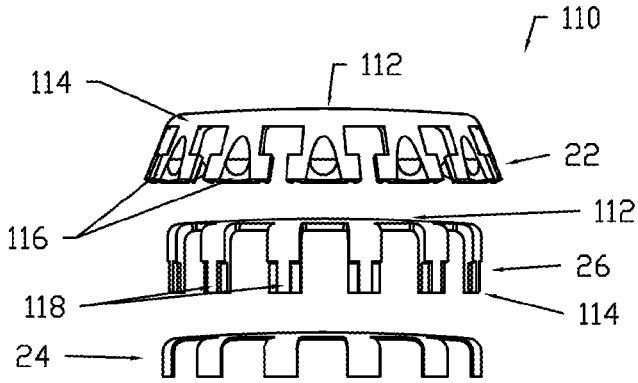
FIG. 3*b* is an exploded side elevation of the closure of FIG. 3*a;*

Referring now to FIGS. 3*a* and 3*b*, there is shown a closure 110 according to a second embodiment of the present invention. The closure 110 comprises a first section 22, and a second section 26.

The first section 22 comprises a body 112 and a skirt 114. The body 112 is generally discoid and planar in shape. The skirt 114 is generally annular having a fixed edge 113, which is fixed to the circumferential edge of the body 112; and a free circumferential edge 113'. The skirt 114 comprises a plurality of spaced apart arms 116, each of which arms 16 is hingedly attached to the body 112, at a fixed edge 113, thereby facilitating operable displacement of each of the arms 116 between an open position and a closed position.

The second section 26 comprises a body 112 and a skirt 114. The body 112 is generally discoid and planar in shape. The skirt 114 is generally annular, and comprises a plurality of spaced apart fingers 118, each of which fingers 118 extends substantially perpendicular from the container-engaging face of the body 112.

The second section 26 is adapted to be received and retained within the first section 22, whereby the exterior face of the second section 26 is located adjacent the container-engagable face of the first section 22, and such that the arms 116 of the first section 22 are tandemly interspersed with the fingers 118 of the second section 26.

The closure 110 according to the second embodiment of the present invention allows for ease of manufacture, as a one-section embodiment may become difficult to manufacture owing to the size and complexity of the parts. A single production injection mould tool would have a large quantity of small, intricate, and delicate components that would be prone to breakage. By producing a two-section closure, separate production injection mould tools having simpler components can be used to produce the separate sections of the closure, and when produced separately each section will retain its own structural integrity.

Referring still to FIG. 3, it is envisaged that a fluid impermeable membrane 24 is provided on the inner surface of the closure 110, which once the closure 110 is applied to a mouth of a container, the membrane 24 forms a fluid-tight barrier. The memebrane 24 may be located at the container-engaging face of the closure 110, or alternatively, at the container-engaging face of the first section 22. The membrane 24 is preferably formed of aluminium, but may be selected by one skilled in the art. A sealing material (not shown) may also be applied at the container-engaging face of the closure 110 to assist in maintaining a fluid tight seal with the container. Suitable materials include thermoplastic elastomers, or thermoplastic block copolymers, such as styrene-ethylene/butylene-styrene (SEBS), or styrene-ethylene/propylene-styrene (SEPS), are also envisaged in the application of the invention.

Figure 3C:
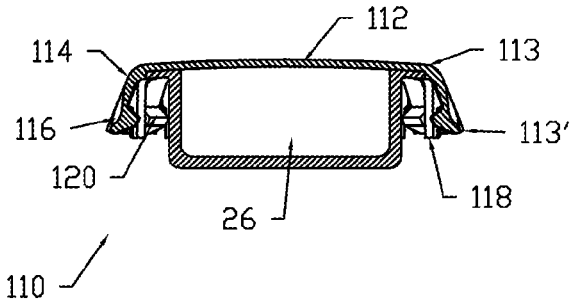
FIG. 3*c* is a sectional side elevation of a closure according to a third embodiment of the present invention.

Referring to FIG. 3*c*, there is shown a closure 110 according to a third embodiment of the present invention. The inner section 26 is adapted to at least partially receive a device, such as a widget, to manage the characteristics of the foam produced by bubbles of gas released from a carbonated liquid. In a preferred embodiment, the inner section 26 is shaped and dimensioned to at least partially house the device, such as a widget (not shown). It is envisaged that the inner section 26 is shaped and dimensioned such that the container-engaging face of the inner section 26 extends along the longitudinal axis of the opening defined by the mouth of the container (not shown), optionally, such that, in use, the device such as a widget is in contact with the liquid in the container.

Figure 5:
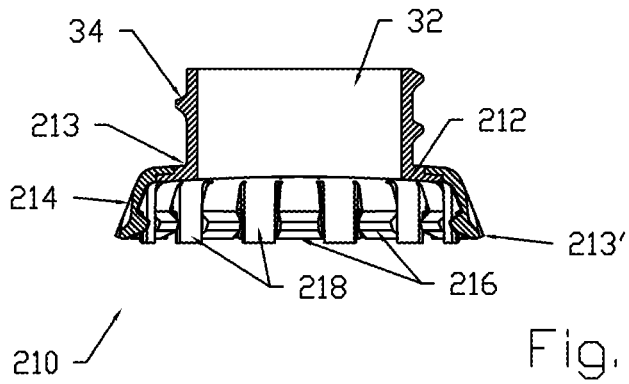
FIG. 5 is a sectional side elevation of a closure according to a fourth embodiment of the present invention.

Referring now to FIG. 5, there is shown a closure 210 according to a fourth embodiment of the present invention. The closure 210 comprises a body 212 and a skirt 214. The skirt 214 is generally annular having a fixed edge 213, which is fixed to the circumferential edge of the body 212; and a free circumferential edge 213'.

The skirt 214 comprises a plurality of arms 216, tandemly interspersed with a plurality of fingers 218. Each of the arms 216 is hingedly attached to the body 212, at a fixed edge 213 of the skirt, thereby facilitating operable displacement of each of the arms of the first set 216 between an open position and a closed position.

Each of the fingers 218 is substantially fixed to the body 212, at a fixed edge 213, and extends substantially perpendicular from the container-engagable face of the body 212.

The body 212 of the closure 210 further comprises a neck 32. The neck 32 is a generally hollow cylinder having first and second open ends. The neck 32 extends generally perpendicular from, and is substantially coaxial with, the exterior face of the body 212. The terminal edge of a first open end of the neck 32 is secured to the body 212 adjacent the fixed edge 213 of the skirt 214. The inner surface of the neck 38 is continuous with the skirt 214, and generally defines an aperture in the body 212. A screw thread 34 is provided on the outer surface of the neck 32 to facilitate the reversible application of a screw cap (not shown).

Figure 6:
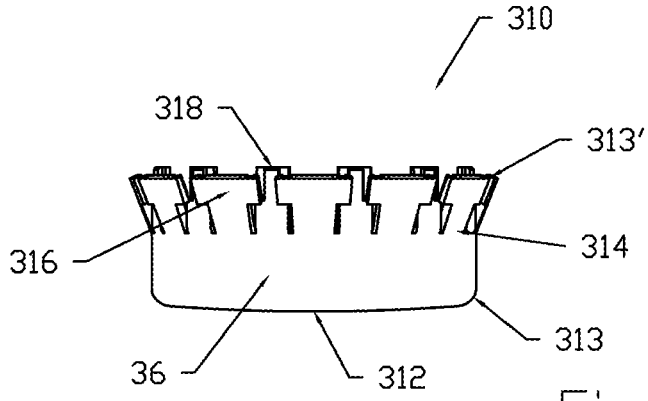
FIG. 6 is a side elevation of a closure according to a fifth embodiment of the present invention.

Referring now to FIG. 6, there is shown a closure 310 according to a fifth embodiment of the present invention. The closure 310 comprises a body 312 and a skirt 314. The body 312 is generally discoid and planar in shape. The skirt 314 is generally annular having a fixed edge 313, which is fixed to the circumferential edge of the body 312; and a free circumferential edge 313'.

The closure 310 is adapted such that at least part of the skirt 314, together with the body 312, forms a stopper 36. The stopper 36 is shaped and dimensioned such that the container-engagable face of the closure 310 can, in use, form an interference fit with the inner surface of the mouth of a container (not shown).

The skirt 314 comprises a plurality of spaced apart arms 316, located adjacent the free circumferential edge 313' of the skirt 314. Each of the arms 316 is hingedly attached to the body 312, at a fixed edge 313 of the skirt, thereby facilitating operable displacement of each of the arms 316 between an open position and a closed position.

In the open position, the arms 316 are coterminous with respect to the skirt 314, such that the terminal circumferential edge 313' is oriented facing substantially away from the body 312. In the closed position, the arms 316 are oriented to be substantially parallel to the skirt 314, each arm 316 facing substantially toward the body 312. It is understood that, in use, the stopper 36, formed from the body 312 and at least part of the skirt 314, is applied to the inner surface of a mouth of a container; wherein the arms 316 extend beyond the terminal edge of the mouth of the container. To seal the opening defined by the mouth of the container, the arms 316 are displaced from the open position to the closed position, such that the each arm 316 locates substantially side-by-side an adjacent arm 316, and adjacent the outer surface of the mouth of the container. Each arm 316 can be deformed by applying energy to the closure 310, as previously described.

Figure 7A:
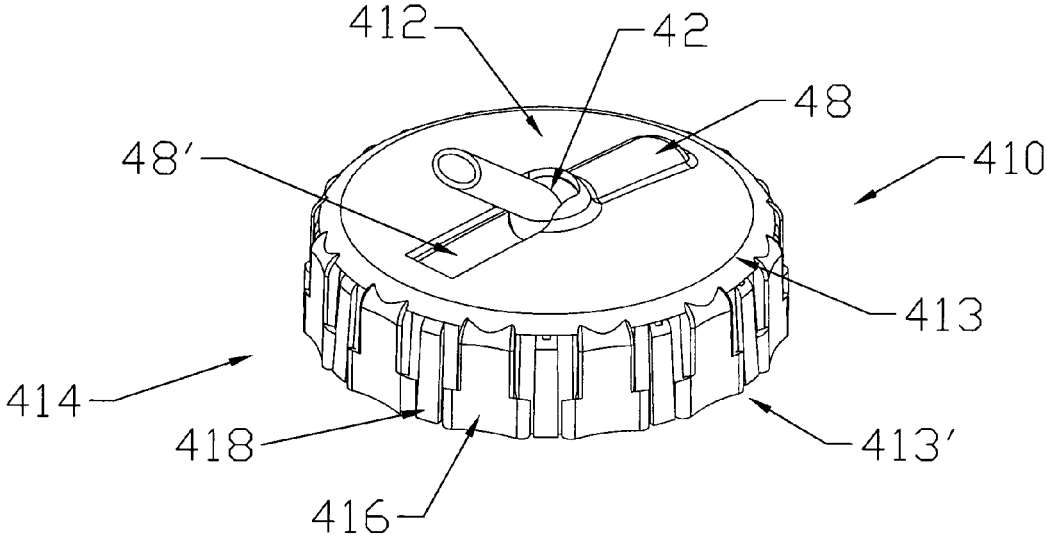
FIG. 7 is a perspective (7*a*) and sectional (7*b*) view of a closure according to a sixth embodiment of the present invention.

Referring to FIG. 7*a*, there is shown a closure 410 according to a sixth embodiment of the present invention. The closure 410 comprises a body 412 and a skirt 414. The body 412 is generally discoid and planar in shape. The skirt 414 is generally annular having a fixed edge 413, which is fixed to the circumferential edge of the body 412; and a free circumferential edge 413'. The skirt 414 of the closure 410 is generally as described herein, having a plurality of spaced apart arms 416, and a plurality of fingers 418. The plurality of arms 416 is tandemly interspersed with the plurality of fingers 418.

The body 412 comprises a spout 40 for dispensing liquids from a container (not shown), once the closure 410 has been applied. The spout 40 is generally a hollow cylinder having open ends, facilitating the passage of liquids therethrough. The spout 40 is, in use, hingedly mounted to the body 412, such that the spout 40 is operable between a closed position and an open position. The spout 40 can be mounted to the body 412 using a mounting means 42. In the present embodiment, the mounting means comprises a ball-and-socket joint, but it is understood that any mounting means, which permits operation of the spout 40 between an open position and a closed position may be utilised.

The mounting means 42 comprises a ball 44 and a socket 46, the ball 44 being, in use, housed within the socket 46, such that the ball 44 is capable of triaxial rotation. The spout 40 is integral to, and passes through, the ball 44.

The socket 46 comprises two channels 48, 48', each of which are shaped and dimensioned to receive opposing ends of the spout 40. Each channel 48, 48' is generally semi-circular in transverse cross-section and having closed ends. A first end of each channel is integral to the socket 46 and the opposing second end of each channel is integral to the body 412.

In the closed position (not shown), the spout 40 is located in each of the respective channels, such that each of the open ends of the spout 40 are adjacent, and form an interference fit with, the closed ends of each of the respective channels 48, 48', thereby forming a liquid-impervious barrier. In the open position, the spout 40 can be hingedly rotated, such that each of the open ends of the spout 40 are free from each of the respective channels 48, 48', thereby allowing the passage of liquid through the spout 40.

Figure 7B:
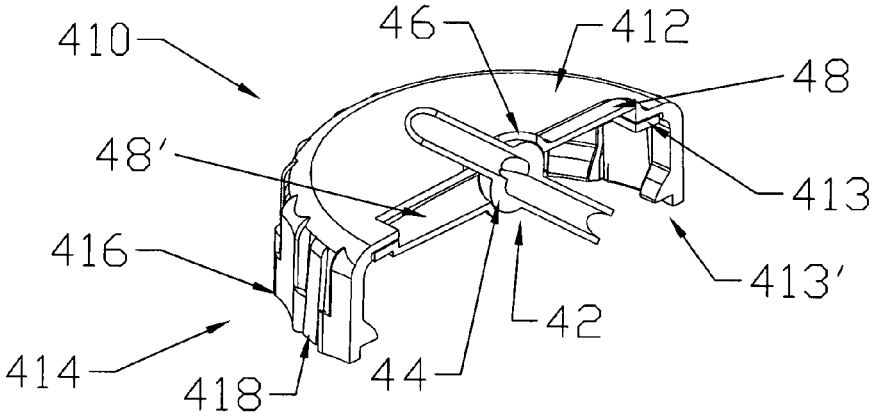

It is intended that a container, such as a plastic bottle (not shown) is first filled aseptically, and then optionally sealed by use of a heat seal foil membrane (not shown). The sixth embodiment of the present invention, as illustrated in FIG. 7, is intended for use with a container so filled, and optionally with a foil sealing the opening. The closure 410 is sealed about or to the opening of the container as previously described, after it has been filled, and the spout 40 is used to both pierce the foil and dispense the liquid in the container. The benefit of this embodiment over the current state of the art is the fact that the bottle does not require a thread form at the opening to receive a screw on cover/closure, but instead only requires a simple bead for application of the present invention. Secondly the present invention is designed to provide a permanently attached device once it is in the closed position to the opening of the container, which will allow it to counteract the force required to pierce the film or foil. It is envisaged that a vertical plunger or screw device (not shown) may alternatively be used to pierce the foil in lieu of the spout illustrated.

FIG. 8 is a side (8*a*) and plan (8*b*) view of an assembly system 50 for sealing an opening defined by a mouth of a container using a closure according to the first aspect of the present invention. The assembly system 50 comprises a conveying means 52, rotating means 54, and deforming means 60.

Figure 8A:
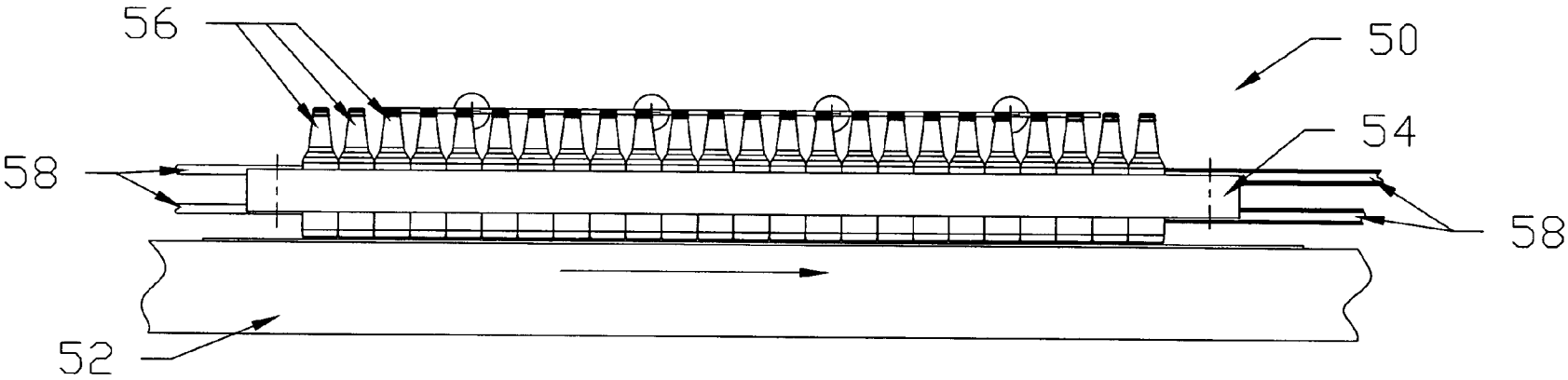
FIG. 8 is a side (8*a*), plan (8*b*), and end (8*c*) view of an assembly system for sealing an opening defined by a mouth of a container using a closure according to the first aspect of the present invention.
Figure 8B:
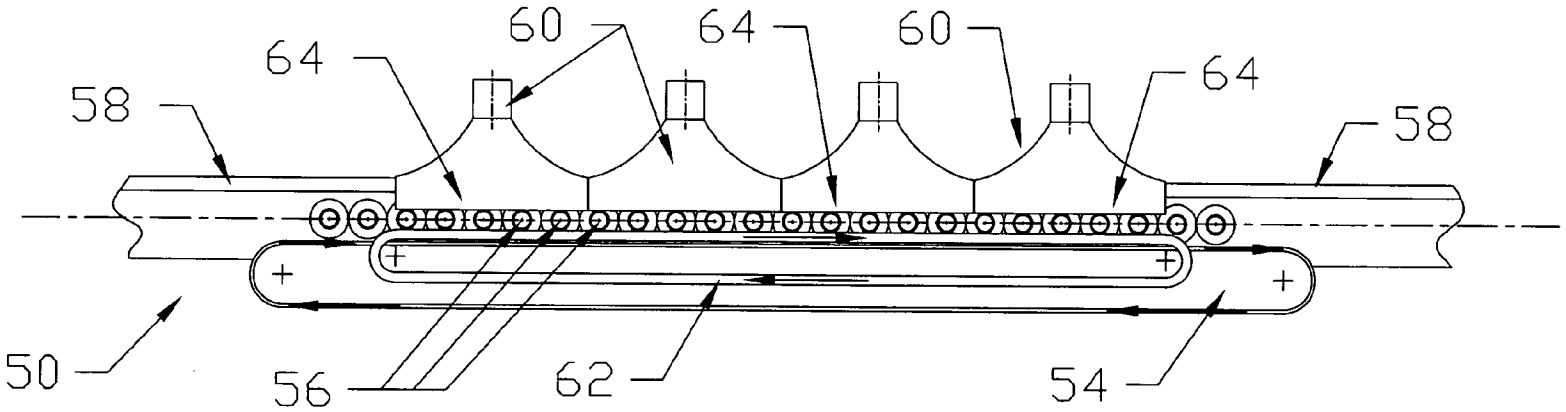

The conveying means 52 comprises a substantially flat belt, which travels in the direction shown in FIG. 8*a*, although, it will be appreciated that the belt could be arranged to operate in the direction shown or in the opposing direction. The belt is shaped and dimensioned to accommodate a series of containers 56, each container having an opening defined by a mouth of the container. The belt is formed from a material of very low friction, such as lubricated stainless steel or polyethylene. The containers 56 are driven through the assembly system by a motor (not shown), which drives the belt in the direction shown. The flat belt may also be static, and the containers 56 allowed to move independently of the surface of the belt.

The conveying means 52 comprises a guide support 58, which guides the containers along the conveying means 52 and allows the conveying means 52 to be adapted to move in a non-liner (or curved) direction.

The rotating means 54 comprises a pulley belt, which is oriented to have a container-engagable face, and a free face. The container engagble face of the pulley belt, in use, contacts each of the containers 56, and is oriented to travel in the direction shown in FIG. 8*b*. In this way, the rotating means 54 applies a directional force to the side of each container 56, which is opposite to the frictional force applied to the side of the container 56 by the guide support 58, which together causes each container 56 to independently rotate about its longitudinal axis.

Each container 56 enters the assembly system 50 in series, and having a closure applied to the opening defined by the mouth of the container.

The deforming means 60 comprises a series of sonotrodes. The number of sonotrodes is dependent on the size of the assembly system 50, and can be chosen by one skilled in the art. Without being bound by theory, it is thought that the greater number of sonotrodes in series the longer the effective energy source and the faster the sealing process. Each sonotrode is generally planar in shape having a terminal edge 64, which extends from the sonotrode and is positioned to contact the closure applied to the opening defined by the mouth of each container 56.

Figure 8C:
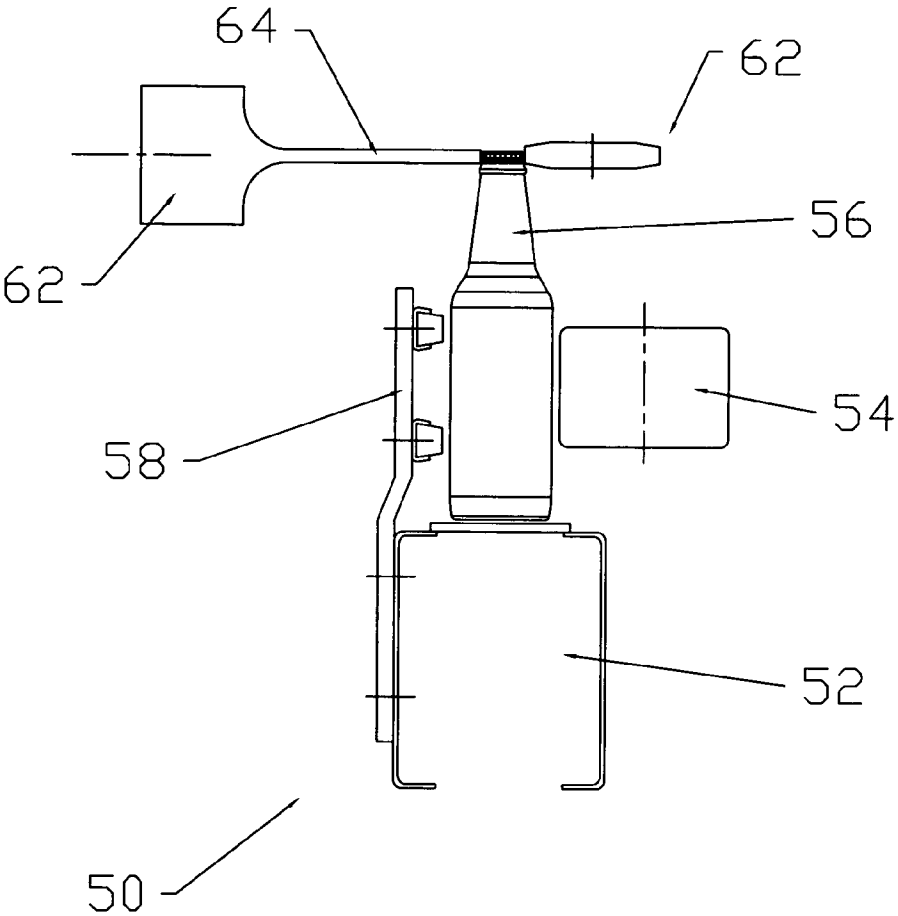

Referring also to FIG. 8*c*, in use, each container 56 is rolled along the guide support 58, and rotates about its longitudinal axis. The part of the closure to be deformed is brought into contact with the terminal edge of each sonotrode. The rotation of the container causes the closure to be simultaneously rolled along the terminal edge of the sonotrode. Optionally, pressure is applied to the opposing side of the closure by a pressure belt 62, which can be travelling in the same or opposite direction of the rotating means 54. The pressure belt 62 may alternatively be static. Each or any of the sonotrodes may be adapted to move a short distance towards each closure for the sealing to take place, while each or any sonotrode may be adapted to move away from each closure once the sealing is completed and to lower the pressure applied to the closure, and permit the assembly system 50 to be vacated of containers 56 as quickly as possible, and subsequently vacated with the next batch of containers 56 to be sealed.

If the energy source is that of an electromagnetic induction coil then it is envisaged that the coil will be bedded in a suitable resin type material.

If electromagnetic induction energy or thermal energy was to be utilised then a single linear source could be sized to suit the throughput of the machine.

Figure 9:
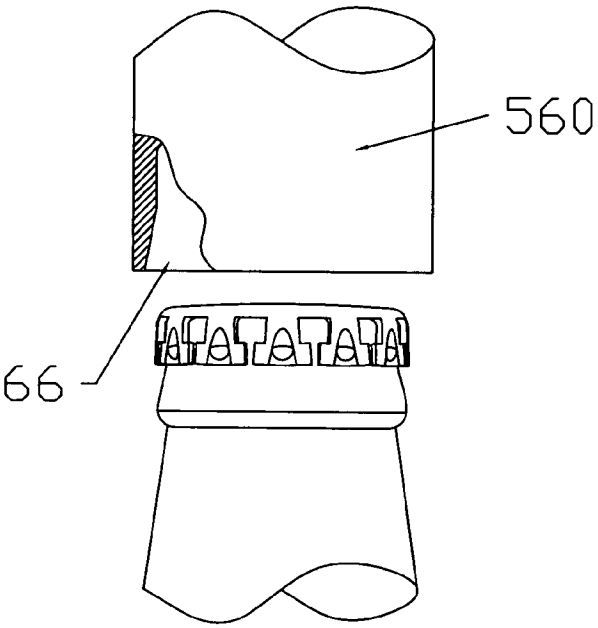
FIG. 9 is a side view of a sonotrode for sealing an opening defined by a mouth of a container using a closure according to the first aspect of the present invention

FIG. 9 illustrates an alternative embodiment of a deforming means 560 for sealing an opening defined by a mouth of a container using a closure according to the present invention. The deforming means 560 comprises a sonotrode, which is generally cylindrical in shape having an open end 66. The open end 66 of the sonotrode is shaped and dimensioned to receive an opening defined by a mouth of a container, to which a closure according to the present invention has been applied. The sonotrode applies energy in the form of ultrasonic vibration simultaneously to the closure to cause deformation.

What is claimed is:

1. A closure for sealing an opening defined by a mouth of a container, the closure comprising an inner section and an outer section; wherein said outer section is adapted to receive the inner section; and wherein said outer section comprises a first body and a plurality of arms extending from the first body where the arms are deformable between an open position and a closed position, and said inner section comprises a second body and a plurality of fingers extending from the second body where the fingers are deformable between an open position and a closed position.

2. A closure according to claim 1, wherein each arm has, in use, a container-engagable face and an exterior face.

3. A closure according to claim 1, wherein, in the open position, the plurality of arms extends substantially radially from the first body.

4. A closure according to claim 2, wherein, in the closed position, at least some of the plurality of arms are oriented such that the container-engagable face of at least some of the arms is located, in use, adjacent the mouth of the container.

5. A closure according to claim 1, wherein each arm is hingedly mounted to the first body.

6. A closure according to claim 1, wherein at least one arm further comprises a retaining element.

7. A closure according to claim 1, wherein the closure further comprises means for securing each arm to an adjacent arm.

8. A closure according to claim 7, wherein the securing means comprises a connection member adapted to form a connection between at least some of the arms, in the closed position.

9. A closure according to claim 7, wherein the securing means comprises an annular member, adapted to at least partially circumscribe at least some of the arms, in the closed position.

10. A closure according to claim 2, wherein each finger has, in use, a container-engagable face and an exterior face.

11. A closure according to claim 1, wherein the plurality of fingers is interspersed with the plurality of arms.

12. A closure according to claim 10, wherein at least some of the plurality of fingers are oriented such that the container-engagable face of at least some of the fingers is located, in use, adjacent an outer surface of the mouth of the container.

13. A closure according to claim 10, wherein at least some of the plurality of fingers are oriented such that the exterior face of some or all of the fingers is located, in use, in side-by-side relationship with an inner surface of the mouth of the container.

14. A closure according to claim 1 wherein at least one finger further comprises a retaining element.

15. A closure according to claim 14, wherein, in use, the retaining element is oriented toward the mouth of the container.

16. A closure according to claim 10, wherein at least part of the exterior face of each finger is adapted to receive at least part of the container-engagable face of an adjacent arm, in the closed position.

17. A closure according to claim 1, wherein the closure is formed from a deformable material.

18. A method of sealing an opening defined by a mouth of a container using a closure comprising an inner section and an outer section; wherein said outer section is adapted to receive the inner section; and wherein said outer section comprises a first body and a plurality of arms extending from the first body, and said inner section comprises a second body and a plurality of fingers extending from the second body; the method comprising the steps of: applying the closure to the mouth of the container, and deforming the plurality of arms and/or the plurality of fingers from an open position to a closed position.

19. A method according to claim 18, wherein the deforming step comprises increasing the internal energy of at least part of the closure by applying energy to the closure.

20. An assembly system for sealing an opening defined by a mouth of a container using a closure comprising an inner section and an outer section; wherein said outer section is adapted to receive the inner section; and wherein said outer section comprises a first body and a plurality of arms extending from the first body, and said inner section comprises a second body and a plurality of fingers extending from the second body; the assembly system comprising means for applying the closure to the mouth of the container, and means for deforming the skirt plurality of arms and/or the plurality of fingers from an open position to a closed position.

* * * * *